US012448237B2

(12) United States Patent
Akiyama

(10) Patent No.: US 12,448,237 B2
(45) Date of Patent: Oct. 21, 2025

(54) SHEET FEEDING APPARATUS

(71) Applicant: Hiroto Akiyama, Yamanashi (JP)

(72) Inventor: Hiroto Akiyama, Yamanashi (JP)

(73) Assignee: CANON FINETECH NISCA INC., Misato (JP)

( * ) Notice: Subject to any disclaimer, the term of this patent is extended or adjusted under 35 U.S.C. 154(b) by 225 days.

(21) Appl. No.: 18/138,309

(22) Filed: Apr. 24, 2023

(65) Prior Publication Data

US 2024/0076150 A1 Mar. 7, 2024

(30) Foreign Application Priority Data

Apr. 25, 2022 (JP) ..... 2022-071725

(51) Int. Cl.

| | |
|---|---|
| ***B65H 1/26*** | (2006.01) |
| ***B65H 1/14*** | (2006.01) |
| ***B65H 3/06*** | (2006.01) |
| ***B65H 7/00*** | (2006.01) |

(52) U.S. Cl.

CPC ..... *B65H 1/266* (2013.01); *B65H 1/14* (2013.01); *B65H 3/0684* (2013.01); *B65H 7/00* (2013.01); *B65H 2402/54* (2013.01); *B65H 2402/60* (2013.01); *B65H 2407/20* (2013.01); *B65H 2515/30* (2013.01)

(58) Field of Classification Search

CPC ..... B65H 3/06; B65H 3/0684; B65H 3/66; B65H 3/68; B65H 1/14; B65H 1/266; B65H 2402/31; B65H 2402/54; B65H 2402/60; B65H 2407/20; B65H 2515/30

See application file for complete search history.

(56) References Cited

U.S. PATENT DOCUMENTS

| | | | | |
|---|---|---|---|---|
| 2011/0210501 | A1* | 9/2011 | Shiokawa | G03G 15/6502 271/145 |
| 2015/0203307 | A1 | 7/2015 | Tanaka et al. | |
| 2018/0148285 | A1* | 5/2018 | Suzuki | B65H 3/06 |
| 2019/0127161 | A1* | 5/2019 | Furumoto | B65H 1/04 |
| 2020/0180883 | A1* | 6/2020 | Liou | B65H 3/5215 |

FOREIGN PATENT DOCUMENTS

| | | | |
|---|---|---|---|
| JP | H11-199070 | A | 7/1999 |
| JP | 2006-335545 | A | 12/2006 |
| JP | 2015-137152 | A | 7/2015 |

* cited by examiner

*Primary Examiner* — Prasad V Gokhale

(74) *Attorney, Agent, or Firm* — HAUPTMAN HAM, LLP

(57) ABSTRACT

Provided is a sheet feeding apparatus provided with a storage chamber for storing sheets, a sheet feeding unit including a delivery roller for contacting the sheet stored in the storage chamber to deliver the sheet from the storage chamber, a support member for supporting the storage chamber to allow the chamber to be installed and pulled out in/from an apparatus main body, and a press force switch mechanism including an operation member to switch a press force used for the delivery roller to contact the sheet, the sheet feeding unit is configured to be capable of being installed and pulled out in/from the main body apparatus integrally with the storage chamber, and the press force switch mechanism is provided in the sheet feeding unit.

10 Claims, 10 Drawing Sheets

SHEET FEEDING APPARATUS

BACKGROUND OF THE INVENTION

1. Field of the Invention

The present invention relates to a sheet feeding apparatus provided with a storage section capable of storing sheets.

2. Description of Related Arts

Conventionally, a sheet feeding apparatus, which supplies sheets to an image forming section of an image forming apparatus, has been provided with a sheet feeding section for feeding sheets stored in a storage section comprised of a sheet cassette, etc.

The sheet feeding section generally includes a delivery roller for feeding sheets of the storage section, and a separation mechanism for separating the sheets fed from the delivery roller to feed. The storage section is configured such that sheets are stacked in a state in which the section is pulled out from a housing, and that after stacking, the section is pushed back to the housing to install, and it is configured that the sheet feeding section and the storage section are capable of being integrally pulled out and installed. Then, when the storage section and sheet feeding section are installed, the delivery roller contacts an uppermost face of the sheets stacked inside a storage chamber by a certain press force to rotate, and delivers the sheet toward the separation mechanism. The sheets fed by the delivery roller are separated by the separation mechanism, and fed toward the image forming section of the image forming apparatus.

In such a sheet feeding apparatus, in the case where types of sheets are different, when the press force acting on the sheet of the delivery roller is certain, there is the problem that multi-feed of sheets and/or absence of sheet feeding occurs.

SUMMARY OF THE INVENTION

A sheet feeding apparatus of the present invention is provided with a storage chamber for storing sheets, a sheet feeding unit including a delivery roller for contacting the sheet stored in the storage chamber to deliver the sheet from the storage chamber, a support member for supporting the storage chamber to allow the chamber to be installed and pulled out in/from an apparatus main body, and a press force switch mechanism including an operation member for switching a press force used for the delivery roller to contact the sheet, the sheet feeding unit is configured to be capable of being installed and pulled out in/from the main body apparatus integrally with the storage chamber, and the press force switch mechanism is provided in the sheet feeding unit.

DETAILED DESCRIPTION OF THE PREFERRED EMBODIMENT

Figure 1:
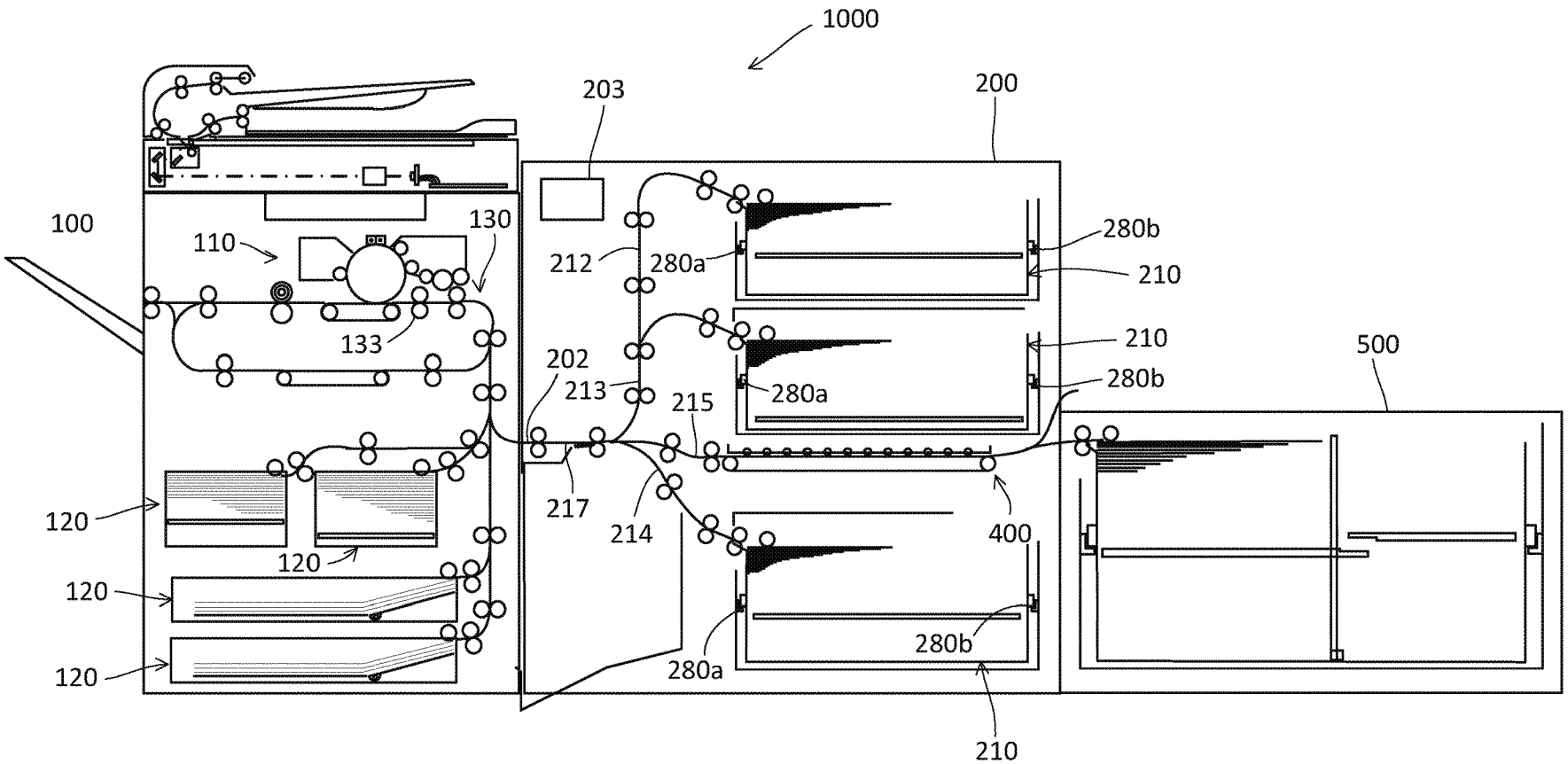
FIG. 1 is a schematic configuration cross-sectional view of an image forming system according to this Embodiment.

This Embodiment will be described, using FIGS. 1 and 2. FIG. 1 is a cross-sectional view schematically illustrating one example of an image forming system provided with a multi-stage storage apparatus and image forming apparatus according to this Embodiment.

An image forming system 1000 of this Embodiment includes an image forming apparatus 100, a multi-stage storage apparatus 200 as a sheet feeding apparatus connected to the image forming apparatus 100, and a sheet feeding deck 500. As described later in detail, the multi-stage storage apparatus 200 includes a plurality of storage sections each capable of storing a plurality of sheets, and is capable of feeding sheets to the image forming apparatus 100 from each of the storage sections. Further, the sheet feeding deck 500 also includes a storage section capable of storing a plurality of sheets, and with respect to a sheet conveyance direction, is disposed on the upstream side of the multi-stage storage apparatus 200. Further, the sheet fed from the sheet feeding deck 500 is conveyed to the image forming apparatus 100 via a relay conveying apparatus 400 provided in the multi-stage storage apparatus 200. Furthermore, the image forming apparatus 100 is provided with an image forming section 110 for forming an image on a sheet, a plurality of sheet feeding sections 120 for storing and feeding sheets, a sheet conveying section 130 for conveying the sheet to the image forming section 110, etc.

The multi-stage storage apparatus 200 is provided with a plurality of storage sections 210, relay conveying apparatus 400, etc. In this Embodiment, three storage sections 210 are arranged vertically in three stages, and the relay conveying apparatus 400 is disposed between the lowermost storage section 210 and the second uppermost storage section 210.

A sheet fed from an uppermost storage section 210 is conveyed to a conveyance path 212, a sheet fed from the second uppermost storage section 210 is conveyed to a conveyance path 213, and a sheet fed from the lowermost storage section 210 is conveyed to a conveyance path 214. Further, a sheet conveyed from the relay conveying apparatus 400 is conveyed to a conveyance path 215. The conveyance path 213 merges with the conveyance path 212 at some point. Further, each of the conveyance paths 212, 214 and 215 merges with one another, and the sheet is conveyed to a conveyance roller pair 201 through a conveyance path 217, and is conveyed to the image forming apparatus 100 via a connection path 202.

As described above, the multi-stage storage apparatus 200 has a plurality of storage sections 210 each capable of storing a plurality of sheets. Respective storage sections 210 are arranged and disposed in a plurality of stages in the vertical direction, and each of the sections is capable of being inserted and pulled out in/from a housing (apparatus main body) 204 of the multi-stage storage apparatus 200 with slide rails 280*a* and 280*b*. In addition, the respective storage sections 210 have the respective different numbers of sheets to store, and are the same in the basic configuration.

The sheets fed from the respective storage sections 210 are conveyed to the connection path 202 (see FIG. 1) via the conveyance paths 212, 213 and 214, respectively. Further, each section of the multi-stage storage apparatus 200 is controlled by a control section 203 (see FIG. 1).

The control section 203 includes a CPU, ROM, RAM, etc. Further, the control section 203 is capable of communicating with a control section 140 of the image forming apparatus 100, and controls feeding timing of the sheet and the like by communicating with the control section 140.

Figure 2:
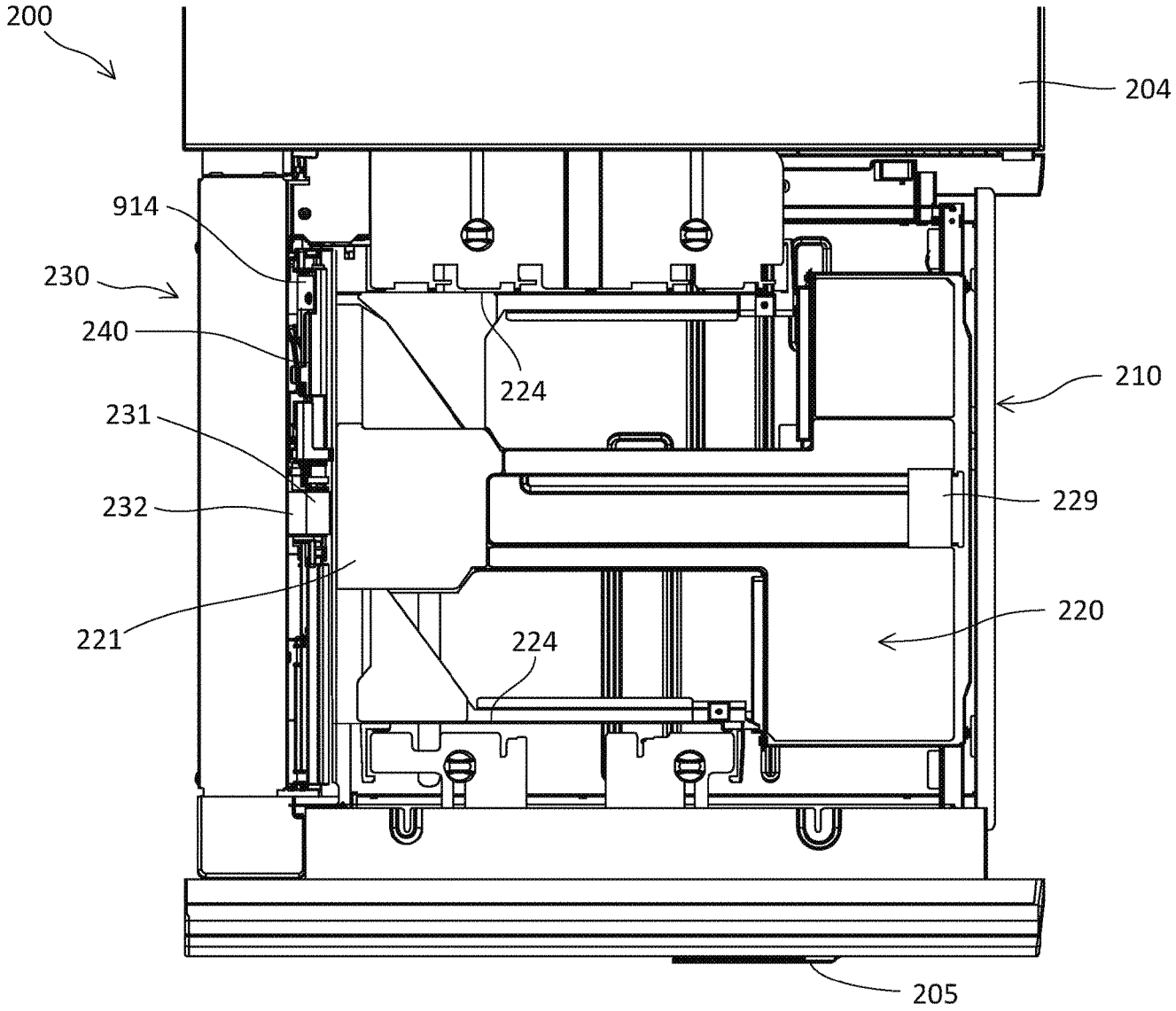
FIG. 2 is a top view illustrating a state in which a storage section is pulled out in a multi-stage storage apparatus according to this Embodiment.

As shown in FIG. 2, the multi-stage storage apparatus 200 has pull-out buttons 205 each as an operation section to perform operation for pulling the storage section 210 out. The pull-out button 205 is provided at the front face of each of the storage sections 210. For example, when an operator presses the pull-out button 205, a lock mechanism for locking the storage section 210 in an installation position is released, and the operator is capable of pulling the storage section 210 out to a position for enabling sheets to be stored.

Figure 3:
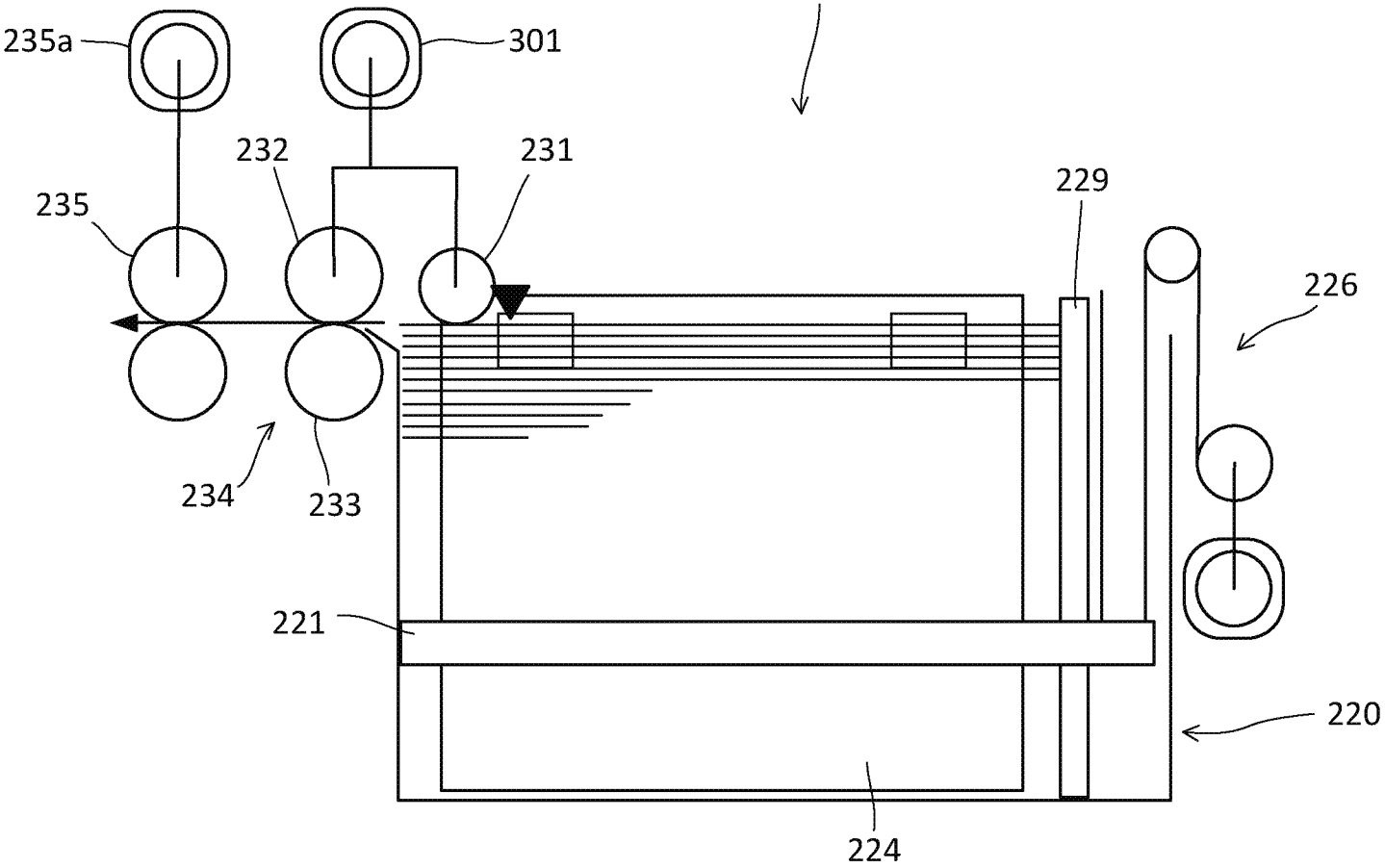
FIG. 3 is a schematic view of the storage section according to this Embodiment.

The storage section 210 has a storage chamber 220 capable of storing sheets, and a sheet feeding section 230 for feeding sheets toward the image forming apparatus 100 from the storage chamber 220. As shown in FIGS. 2 and 3, the storage section 210 also has a stack tray 221 to stack sheets, rear end regulation plate 223, side regulation plates 224, etc., and the stack tray 221, rear end regulation plate 223 and side regulation plates 224 are provided in the storage chamber 220. The stack tray 221 is capable of moving up and down in the vertical direction with an up-and-down mechanism 226.

In the case of this Embodiment, as described above, the sheet feeding section (sheet feeding unit) 230 is provided in the storage section 210. Therefore, when the storage section 210 is pulled out and inserted from/in the housing 204 of the multi-stage storage apparatus 200, the sheet feeding section shifts together with the storage section 210. Thus, by configuring that the sheet feeding section 230 is capable of being pulled out together with the storage section 210, maintenance such as a change of each roller of the sheet feeding apparatus 230 is made ease.

Figure 4A:
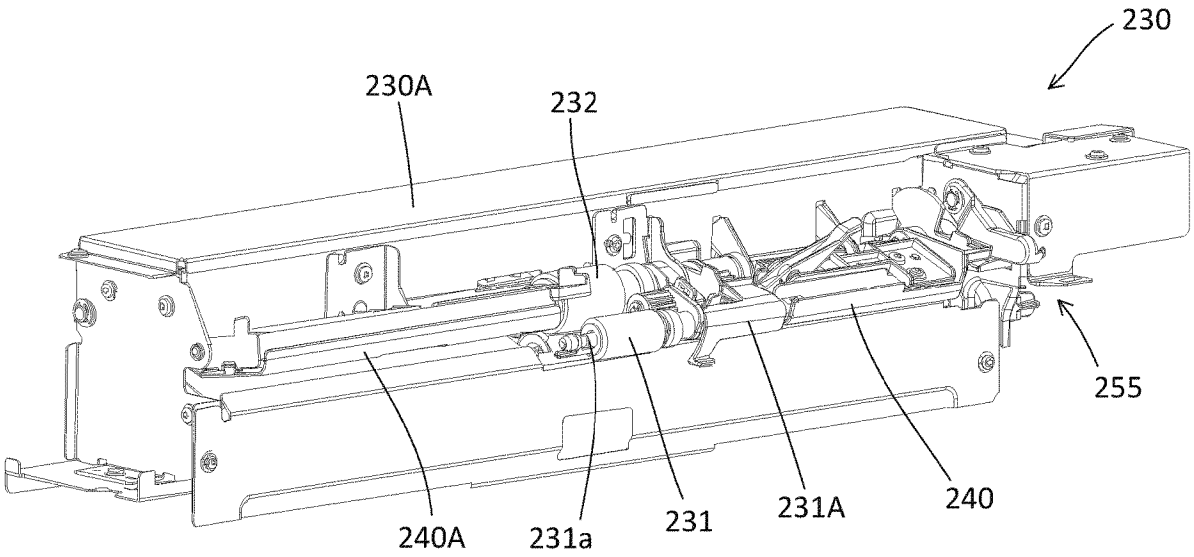
FIG. 4A is a perspective view illustrating a sheet feeding position of a sheet feeding section according to this Embodiment.
Figure 4B:
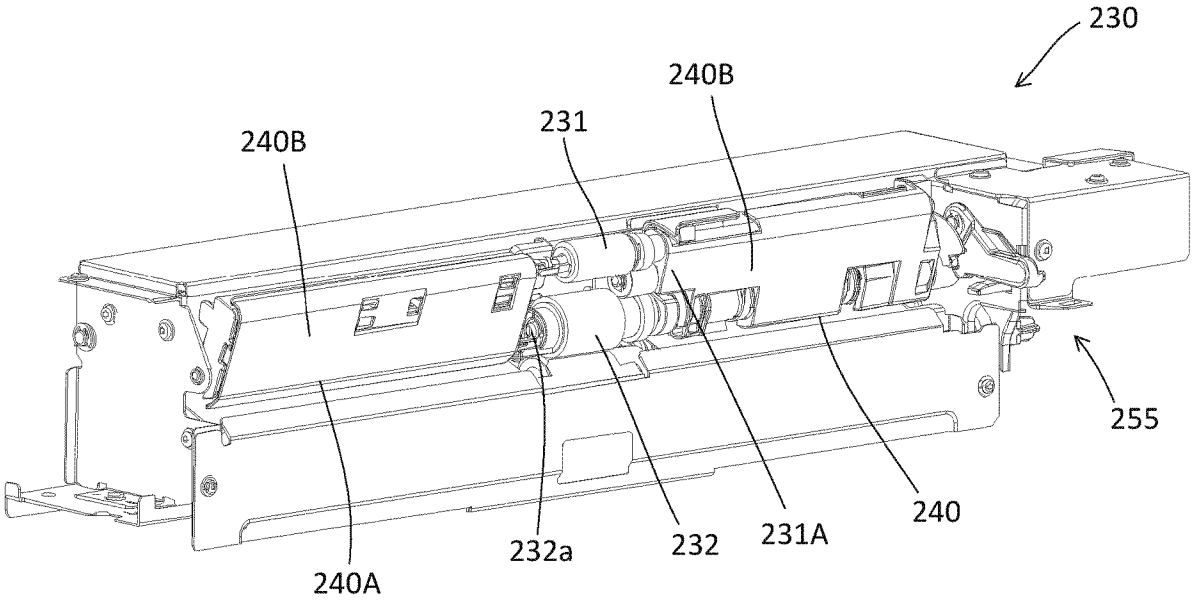
FIG. 4B is a perspective view illustrating a retract position of the sheet feeding section according to this Embodiment.

As shown in FIGS. 3, 4A and 4B, the sheet feeding section 230 is provided with a delivery roller 231, separation carrying section 234, and conveyance roller pair 235. Further, the section 230 has support plates 240, 240A (see FIGS. 4A and 4B) as a guide member, a shift mechanism 255 for shifting the delivery roller 231, etc. The separation section 234 is comprised of a sheet feeding roller 232 for conveying a sheet fed by the delivery roller 231, and a separation roller 233 for coming into press-contact with the sheet feeding roller 232. The support plate 240 supports the delivery roller 231 rotatably. In addition, as shown in FIG. 3, it is configured that the delivery roller 231 and sheet feeding roller 232 are driven by a sheet feeding motor 301, and that the conveyance roller pair 235 is driven by a conveyance motor 235*a*.

Further, as shown in FIGS. 4A and 4B, the support plate 240A is disposed on the side opposite to the support plate 240 with the delivery roller 231 and sheet feeding roller 232 therebetween. The support plate 240A functions as the guide member for guiding the top face of the sheet fed by the delivery roller 231, together with the support plate 240.

The shift mechanism 255 shifts between a sheet feeding position in which the delivery roller 231 contacts the sheet to feed the sheet, and a retract position in which the delivery roller 231 retracts from the sheet. The shift mechanism 255 of this Embodiment rotates about a rotation shaft 232*a* of the sheet feeding roller 232, as the center, and thereby shifts the delivery roller 231 to the retract position. In other words, the delivery roller 231 is capable of shifting between the sheet feeding position for coming into contact with the sheet stored in the storage chamber 220 and the retract position retracted from the sheet stored in the storage chamber 220. In addition, the shift mechanism 255 shifts the delivery roller to the sheet feeding position when the storage section 210 is installed in the housing 204, while shifting the delivery roller to the retract position when the storage section 210 is pulled out from the housing 204.

With specific descriptions being given, the support plate 240 is supported rotatably with respect to the rotation shaft 232*a* of the sheet feeding roller 232. In other words, the support plate 240 is swingable about the rotation shaft 232*a* (swing shaft), as the center, of the sheet feeding roller 232. The rotation shaft 232*a* of the sheet feeding roller 232 is disposed approximately parallel with a rotation shaft line of the delivery roller 231 that is a rotating body.

As shown in FIG. 4A, the rotation shaft 231*a* of the delivery roller 231 is supported rotatably by the support plate 240. Accordingly, when the support plate 240 swings about the rotation shaft 232*a*, as the center, of the sheet feeding roller 232, the delivery roller 231 also swings about the rotation shaft 232*a* as the center. By this means, the delivery roller 231 shifts in the vertical direction. In other words, the delivery roller 231 performs up-and-down motion with respect to sheets stacked on the stack tray 221. Specifically, the delivery roller 231 is capable of moving up and down between the sheet feeding position shown in FIG. 4A and the retract position shown in FIG. 4B. In addition, in this Embodiment, the support plate 240, delivery roller 231 and rotation shaft 231*a* are made a unit as a delivery unit 231A, and shift by the shift mechanism.

The sheet feeding position is the position in which the delivery roller 231 comes into contact with the uppermost sheet stacked on the stack tray 221 to be able to feed the sheet. Therefore, in this Embodiment, it is configured that the delivery roller 231 shifts to the sheet feeding position that is the position for enabling the sheet to be fed, when the storage section 210 is installed. In the sheet feeding position, as shown in FIG. 4A, the support plates 240, 240A are also positioned in positions opposed to the sheet inside the storage chamber 220, and guide the top face of the sheet fed by the delivery roller 231.

The retract position is a position for enabling sheets to be stored in the storage chamber 220, and is a position in which the delivery roller 231 retracts from the sheet feeding position, when the sheets are stored in the storage chamber 220. When the storage section 210 is pulled out, in the case where the delivery roller 231 is positioned in the sheet feeding position, the delivery roller 231 interferers with sheets in stacking the sheets on the stack tray 221, and stacking of the sheets is made hard. Therefore, in this Embodiment, when the storage section 210 is pulled out, it is configured that the delivery roller 231 shifts to the retract position that is the position in which the roller 231 is hard to interfere with stacking of the sheets.

In such a retract position, as shown in FIG. 4B, guide faces 240B for guiding the sheet of the support plates 240, 240A stand with respect to the sheet feeding direction of the sheet by the delivery roller 231. In other words, the guide face 240B is approximately parallel with the sheet feeding direction of the sheet in the sheet feeding position, and in the retract position, shifts to a direction closer to the vertical direction than the sheet feeding direction.

As described above, the shift of the delivery roller 231 from the sheet feeding position to the retract position is performed, using the rotation axis of the rotation shaft 232*a* of the sheet feeding roller 232, as the center. In other words, by swinging the delivery unit 231A upward about the rotation shaft 232*a*, as the center, from the sheet feeding position shown in FIG. 4A, the delivery roller 231 shifts to the retract position shown in FIG. 4B.

Figure 5:
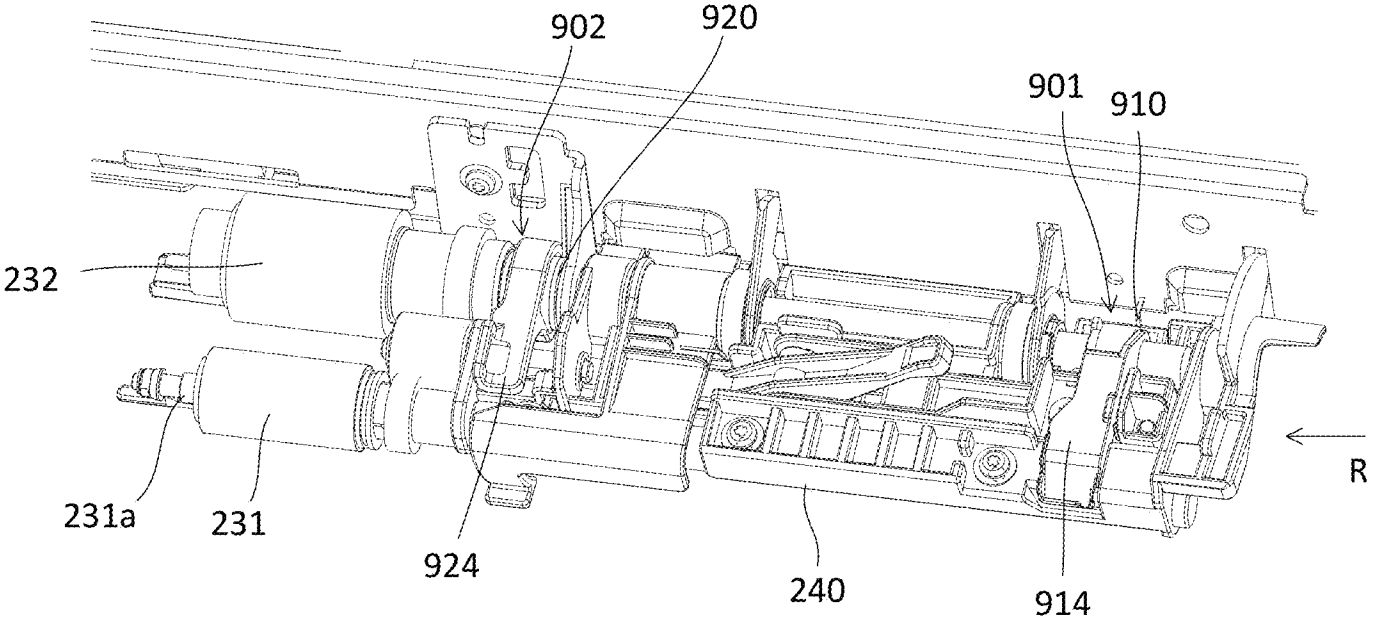
FIG. 5 is a perspective view illustrating a state in which the sheet feeding section according to this Embodiment is positioned in the sheet feeding position.

Herein, as shown in FIG. 5, the sheet feeding section 230 has a first adjustment mechanism (first press force switch mechanism) 901 and a second adjustment mechanism (second press force switch mechanism) 902. The first adjustment mechanism 901 has a first lever 914 as a first operation section, and a first biasing spring 910 as a first biasing means. The first biasing spring 910 is provided to be able to bias the delivery roller 231 supported by the support plate 240 toward the sheet on the stack tray 221. In other words, the first biasing spring 910 is capable of biasing the support plate 240 via the first lever 914 downward about the rotation shaft 232*a* as the center i.e. is capable of biasing the delivery roller 231 to the sheet on the stack tray 221. By operation of the first lever 914, it is possible to adjust the press force used for the delivery roller 231 to contact the sheet.

The second adjustment mechanism 902 has a second lever 924 as a second operation section, and a second biasing spring 920 as a second biasing means. The second biasing spring 920 is provided to be able to bias the delivery roller 231 supported by the support plate 240 toward the sheet feeding position from the retract position. In other words, the second biasing spring 920 is capable of biasing the support plate 240 via the second lever 924 downward about the rotation shaft 232*a* as the center i.e. in a direction in which the delivery roller 231 moves to the sheet on the stack tray 221. By operation of the second lever 924, it is possible to adjust the press force used for the delivery roller 231 to contact the sheet. The first adjustment mechanism 901 and second adjustment mechanism 902 constitute a switch mechanism for switching the biasing force for biasing the delivery roller 231 toward the sheet on the stack tray 221.

Figure 6A:
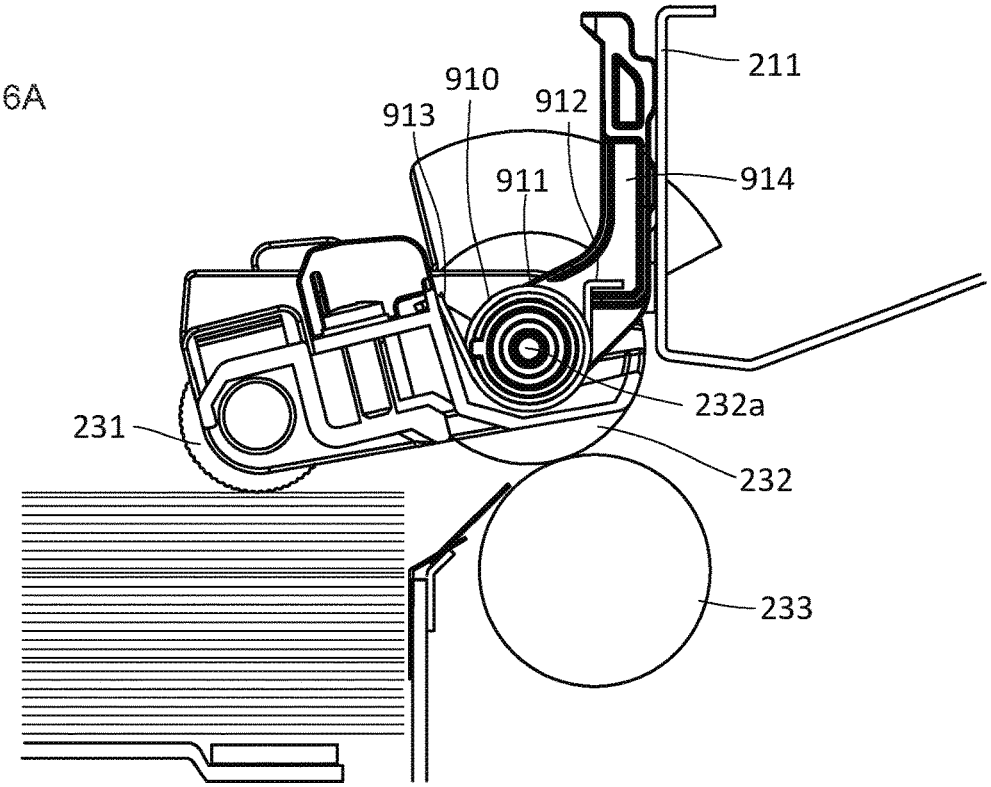
FIG. 6A is a side elevational view of a first biasing position, illustrating a first adjustment section according to this Embodiment.
Figure 6B:
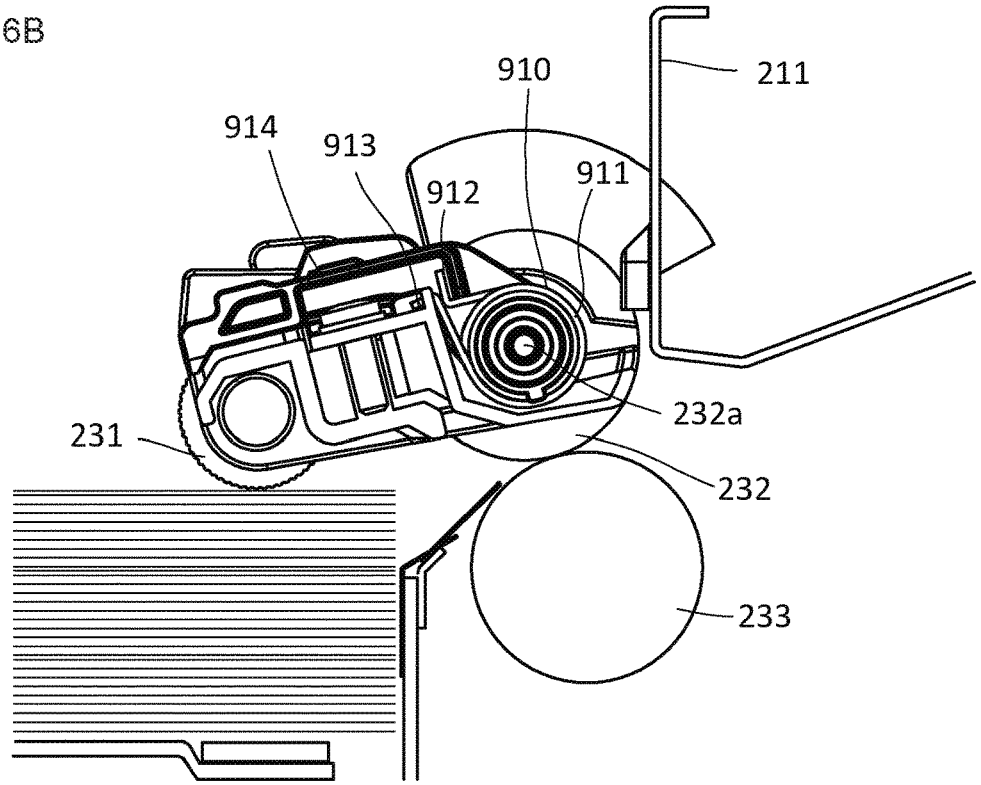
FIG. 6B is a side elevational view of a first non-biasing position, illustrating the first adjustment section according to this Embodiment.

FIGS. 6A and 6B are cross-sectional views of the first adjustment mechanism 901 viewed from the arrow R direction in FIG. 5. As shown in FIGS. 6A and 6B, the first lever 914 is provided to be swingable about the rotation shaft 232*a* as the center. The first biasing spring 910 is a torsion coil spring, and has a coil portion 911, a hang portion 912 that is one end portion, and a hang portion 913 that is the other end portion. The coil portion 911 is attached to the outer circumferential portion of the rotation shaft 232*a*. The hang portion 913 hangs in a part of the support plate 240. The hang portion 912 hangs in a part of the first lever 912.

The first lever 914 is capable of shifting to a first biasing position shown in FIG. 6A and a first non-biasing position shown in FIG. 6B, by swinging. As shown in FIG. 6A, the first lever 914 is pressed against a frame 211 by the first biasing spring 910 in the first biasing position. Therefore, when the first lever 914 is positioned in the first biasing position, the first biasing spring 910 applies a biasing force for biasing the delivery roller 231 from the retract position to the sheet feeding position with respect to the frame 211 via the first lever 914 i.e. biasing force for pressing against the sheet on the stack tray 221. On the other hand, as shown in FIG. 6B, the first lever 914 is fixed to the support plate 240 in the first non-biasing position. Therefore, when the first lever 914 is positioned in the first non-biasing position, the first biasing spring 910 is caught between the first lever 914 and the support plate 240, and the biasing force is cancelled. In other words, the first lever 914 shifts to the first biasing position for applying the biasing force of the first biasing spring 910 to the delivery roller 231, and the first non-biasing position for not applying.

Figure 7:
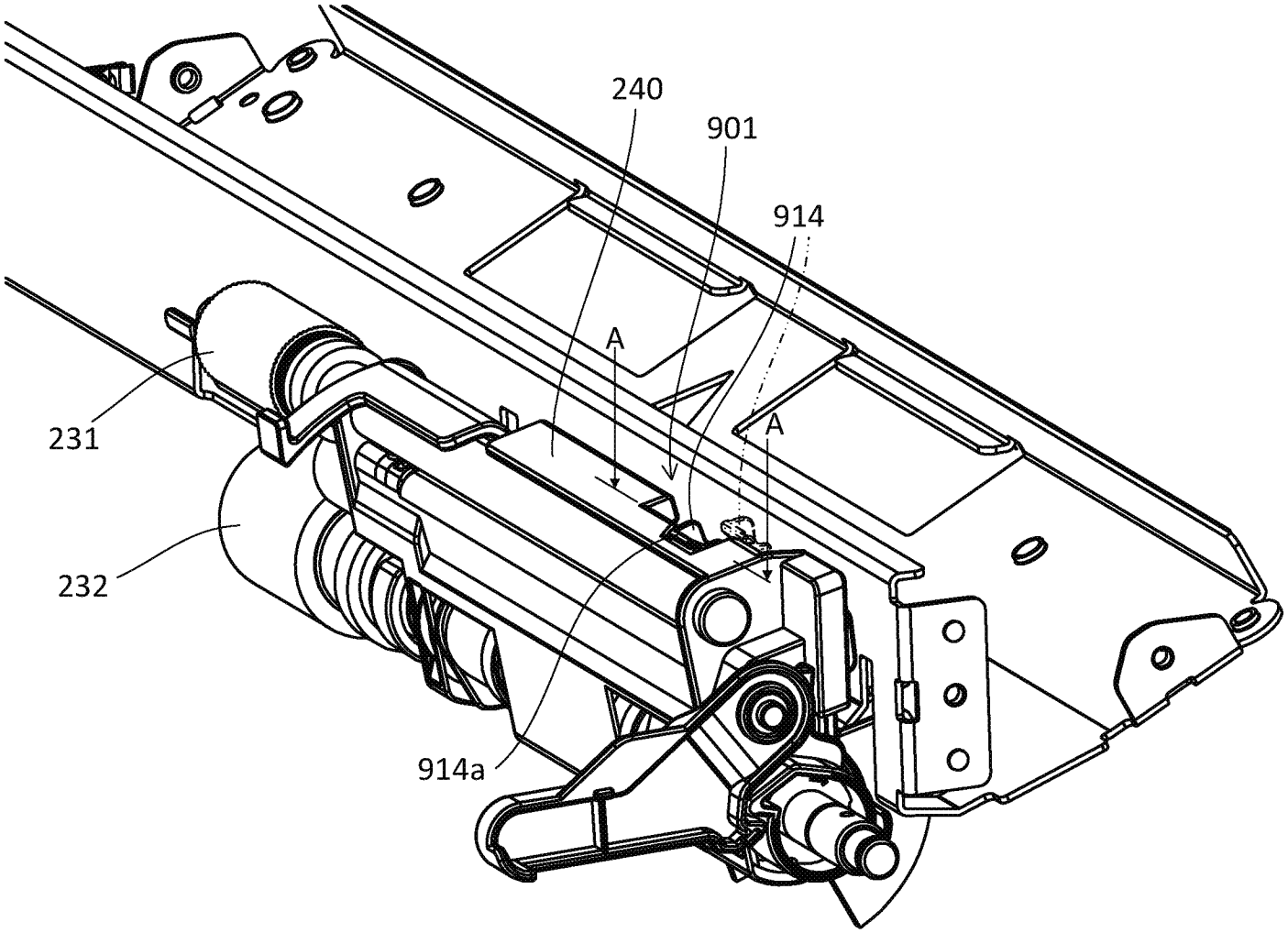
FIG. 7 is a perspective view illustrating a state in which the sheet feeding section according to this Embodiment is positioned in a first retract position.

Herein, descriptions will be given to a configuration for fixing the first lever 914 to the support plate 240 in the first non-biasing position. FIG. 7 is a perspective view illustrating the first lever 914 and support plate 240 when the delivery roller 231 is in the retract position. With respect to the first lever 914, the solid line indicates the first-non biasing position, the two-dot chain line indicates the first biasing position, and in both of cases, a grasp portion 914*a* at the front end is exposed upward. In other words, as shown in FIG. 2, the first lever 914 is disposed in a position in which the lever is exposed to be operable when the storage section 210 is pulled out from the housing 204. When at least the pick-up roller 231 is positioned in the retract position, the first lever 914 is disposed in the position in which the lever is exposed to be operable. Even when the delivery roller 231 is in the retract position, a user is capable of operating the first lever 914.

Figure 8:
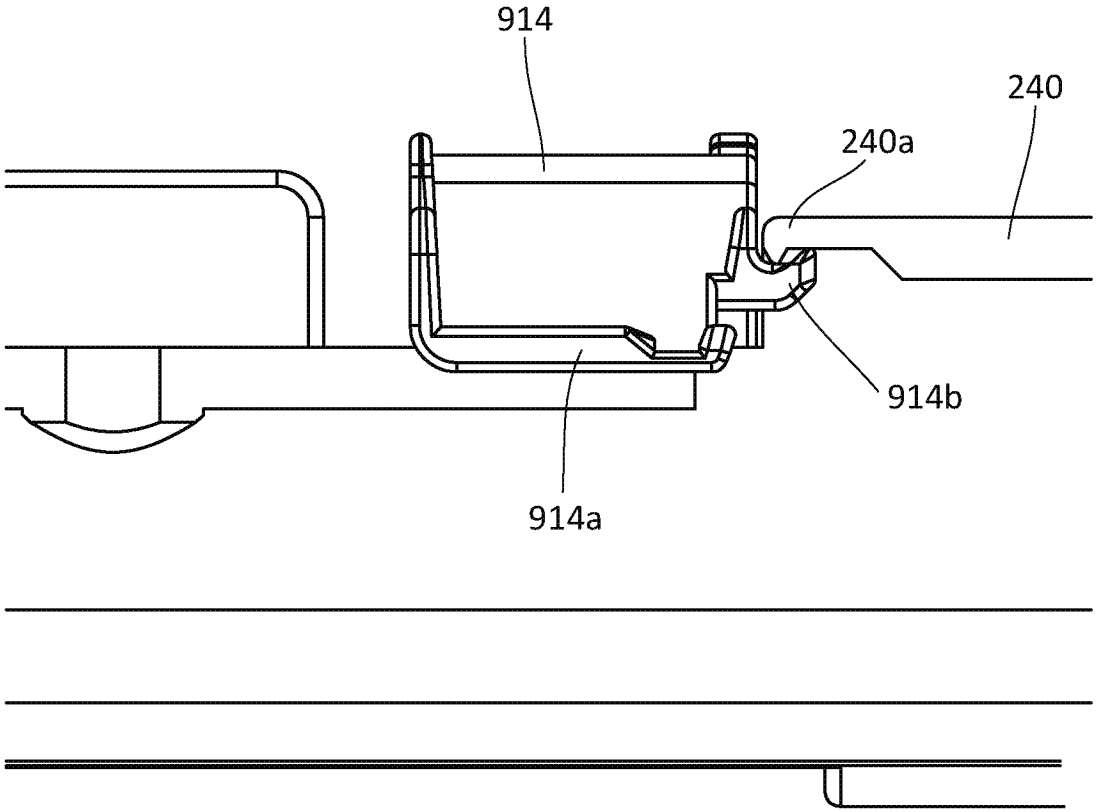
FIG. 8 is a cross-sectional view illustrating a state cut along the line A-A of FIG. 7.

FIG. 8 is a cross-sectional view illustrating a state cut along the A-A line in FIG. 7. As shown in FIG. 8, in the grasp portion 914*a* of the first lever 914 is formed a hook portion (engagement portion) 914*b* protruding to the side. Further, in a position opposed to the hook portion 914*b* of the support plate 240 is formed a receiving portion (portion to be engaged) 240*a*. As shown in FIG. 8, when the first lever 914 is positioned in the first non-biasing position, the hook portion 914*b* is caught in the receiving portion 240*a*, the first lever 914 is fixed to the support plate 240, and it is possible to disable the biasing force of the first biasing spring 910.

In this Embodiment, the first lever 914 is used, when the user adjusts the press force of the delivery roller 231 corresponding to weighing of the sheet. For example, in the case of using sheets with weighing of a predetermined value or more, the user sets the press force high, while in the case of using sheets with weighing smaller than the predetermined value, setting the press force low. In other words, the first lever 914 is capable of shifting to the first biasing position (first position) for bringing the delivery roller 231 into contact with the sheet by a first press force, and the first non-biasing position (second position) for bringing the delivery roller 231 into contact with the sheet by a second press force lower than the first press force. In addition, as shown in FIGS. 6A and 6B, it is preferable to paste, on the top face of the sheet feeding section 230, a label 236 describing that the press force is set high in the case of using sheets with weighing of the predetermined value or more, and that the press force is set low in the case of using sheets with weighing smaller than the predetermined value. By this means, it is possible to aim to inform users of cautions.

Figure 9A:
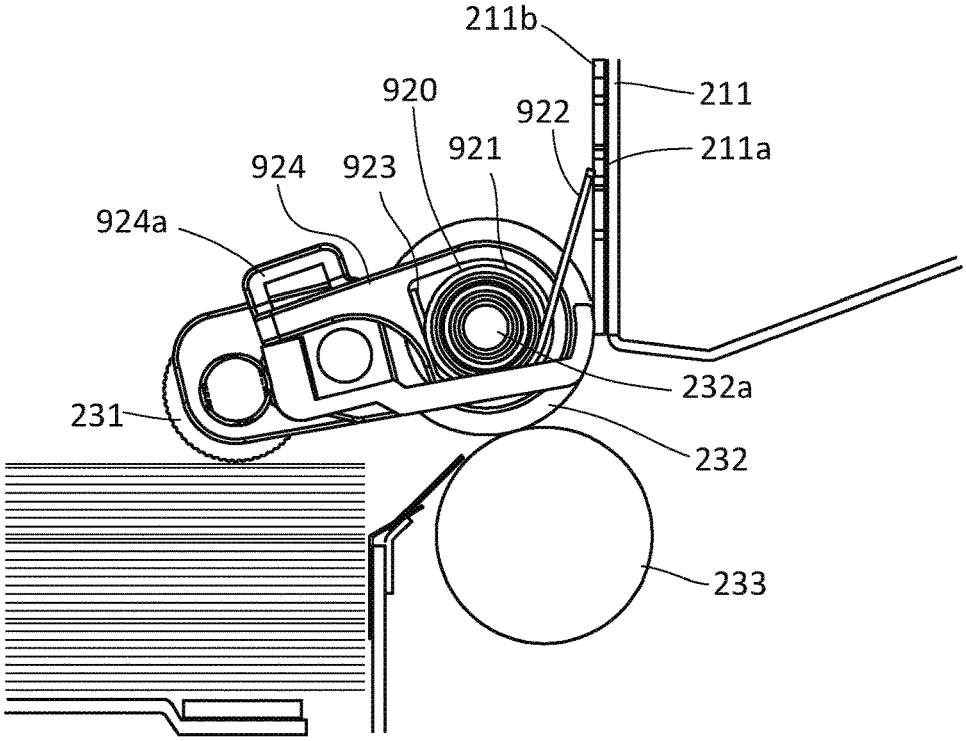
FIG. 9A is a side elevational view of a second biasing position, illustrating a second adjustment section according to this Embodiment.
Figure 9B:
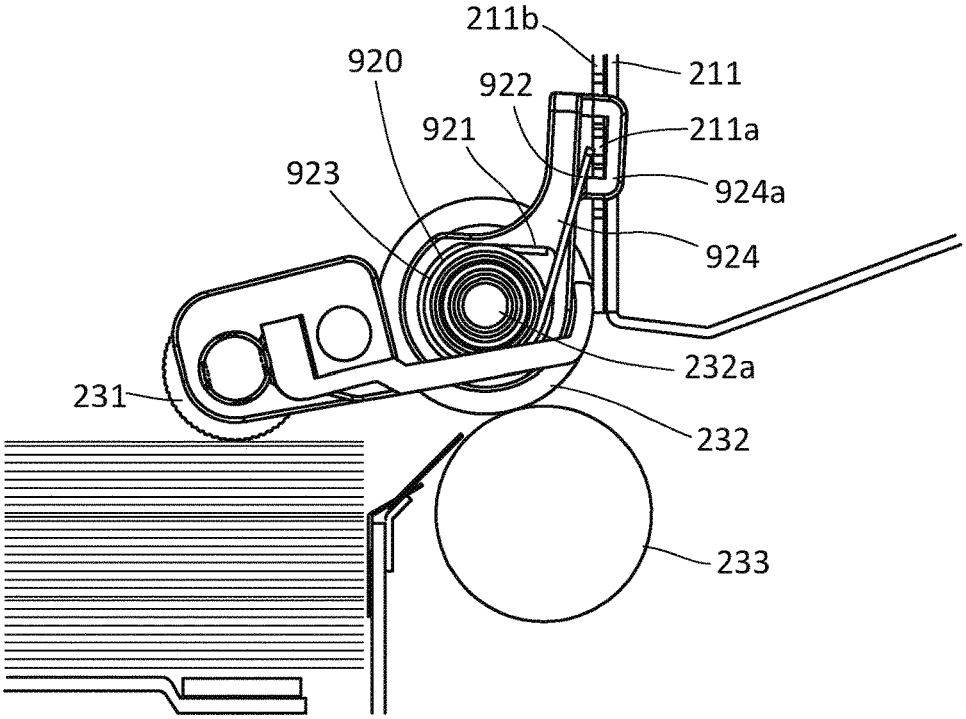
FIG. 9B is a side elevational view of a second non-biasing position, illustrating the second adjustment section according to this Embodiment.

FIGS. 9A and 9B are cross-sectional views of the second adjustment mechanism 902 viewed from the arrow R direction in FIG. 5. As shown in FIGS. 9A and 9B, the second lever 924 is provided to be swingable about the rotation shaft 232*a* as the center. The second biasing spring 920 is a torsion coil spring, and has a coil portion 921, a hang portion 922 that is one end portion, and a hang portion 923 that is the other end portion. The coil portion 921 is attached to the outer circumferential portion of the rotation shaft 232*a*. The hang portion 922 hangs in a part of the frame 211. The hang portion 923 hangs in a part of the second lever 924. In addition, in this Embodiment, provided is a bracket 211*b* which functions integrally with the frame 211 as a part of the frame 211, and the hang portion 922 described above hangs in the bracket 211*b*.

The second lever 924 is capable of shifting to a second biasing position shown in FIG. 9A and a second non-biasing position shown in FIG. 9B, by swinging. As shown in FIG. 9A, the second lever 924 is pressed against the support plate 240 by the second biasing spring 920 in the second biasing position. Therefore, when the second lever 924 is positioned in the second biasing position, the second biasing spring 920 applies a biasing force for biasing the delivery roller 231 from the retract position to the sheet feeding position via the second lever 924 i.e. biasing force for pressing against the sheet on the stack tray 221. On the other hand, as shown in FIG. 9B, the second lever 924 hangs in the bracket 211*b* in the second non-biasing position. Therefore, when the second lever 924 is positioned in the second non-biasing position, the second biasing spring 920 is caught between the second lever 924 and the frame 211, and the biasing force is cancelled. In other words, the second lever 924 shifts to the second biasing position for applying the biasing force of the second biasing spring 920 to the delivery roller 231, and the second non-biasing position for not applying.

Figure 10A:
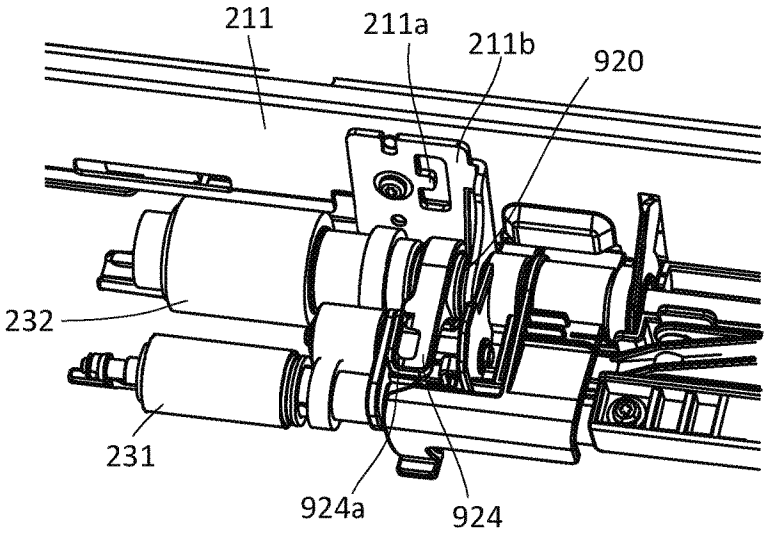
FIG. 10A is a perspective view of the second biasing position, illustrating the second adjustment section according to this Embodiment.
Figure 10B:
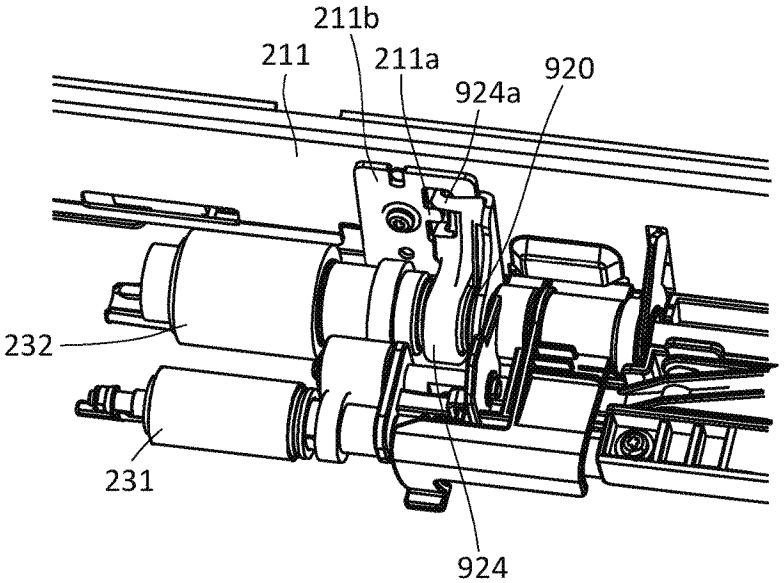
FIG. 10B is a perspective view of the second non-biasing position, illustrating the second adjustment section according to this Embodiment.

Herein, descriptions will be given to a configuration for hanging the second lever 924 in the bracket 211*b* in the second non-biasing position to fix. As shown in FIG. 10A, an engagement portion 924*a* is formed in the second lever 924. Further, a hook portion 211*a* is formed in the bracket 211*b*, and is formed in a position opposed to the engagement portion 924*a*. When the delivery roller 231 is positioned in the sheet feeding position, the second lever 924 is swung from the second biasing position to the second non-biasing position. As shown in FIG. 10B, when the second lever 924 is positioned in the second non-biasing position, the engagement portion 924*a* hangs in the hook portion 211*a*, the second lever 924 is fixed to the bracket 211*b*, and it is possible to disable the biasing force of the second biasing spring 920.

Further, as shown in FIG. 2, in a state in which the storage section 210 is pulled out from the housing 204, when the delivery roller 231 is positioned in the retract position, the second lever 924 is not exposed. In other words, when the delivery roller 231 is positioned in the sheet feeding position, the second lever 924 is operable, while being disposed in a position to be not operable when the delivery roller 231 is positioned in the retract position. Since the purpose of the second lever 924 is not for users, and for operation by a service person, in order to prevent operation from being performed when the delivery roller 231 is in the retract position, the second lever 924 is covered with the support plate 240 in the state in which the delivery roller 231 is in the retract position. In other words, the second lever 924 is disposed in the position in which it is not possible to operate the lever 924 when the storage section 210 is pulled out from the housing 204.

In this Embodiment, for example, the second lever 924 is used for the service person to adjust the press force of the delivery roller 231 so as to reduce stains of the sheet by the delivery roller 231. For example, in the case of decreasing the stain, the press force is set low. In other words, the second lever 924 is capable of shifting to the second biasing position (first position) for bringing the delivery roller 231 into contact with the sheet by a first press force, and to the second non-biasing position (second position) for bringing the delivery roller 231 into contact with the sheet by a second press force lower than the first press force.

The press force when the delivery roller 231 comes into contact with the sheet is set at a total sum of the biasing force of the first biasing spring 910, the biasing force of the second biasing spring 920, and respective weight W of the delivery roller 231, support plate 240 and the like. For example, it is assumed that the first lever 914 applies a biasing force F1 in the first biasing position, and does not apply the biasing force in the first non-biasing position. Similarly, it is assumed the second lever 924 applies a biasing force F2 different from the biasing force F1 in the second biasing position, and does not apply the biasing force in the second non-biasing position. In this case, it is possible to set the following four stages of press forces by combinations of positions of the first lever 914 and the second lever 924, and it is possible to enhance flexibility as compared with the case where the operation section is single.

(1) The first lever 914 is in the first biasing position, and the second lever 924 is in the second biasing position.

$$\text{The press force}=F1+F2+W$$

(2) The first lever 914 is in the first biasing position, and the second lever 924 is in the second non-biasing position.

$$\text{The press force}=F1+W$$

(3) The first lever 914 is in the first non-biasing position, and the second lever 924 is in the second biasing position.

$$\text{The press force}=F2+W$$

(4) The first lever 914 is in the first non-biasing position, and the second lever 924 is in the second non-biasing position.

$$\text{The press force}=W$$

As described above, to a retract member 251 for shifting the delivery roller 231 supported by the support plate 240 toward the retract position, in the case where the rotation shaft 232*a* rotates in a direction opposite to the sheet conveyance direction of the sheet feeding roller 232 by a one-way clutch 252, drive is transferred to the member 251 from the rotation shaft 232*a*. On the other hand, in the case where the rotation shaft 232*a* rotates in the opposite direction, drive is not transferred to the retract member 251 from the rotation shaft 232*a*. In this case, the one-way clutch 252 idles, and the delivery roller 231 supported by the support plate 240 swings in a direction for moving from the retract position to the sheet feeding position, by the total sum of its own weight, and adjusted biasing forces of the first biasing spring 910 and second biasing spring 920 described above. Accordingly, the retract member 251 is driven by backward rotation of the sheet feeding motor 301, shifts the delivery roller 231 supported by the support plate 240 from the sheet feeding position to the retract position, and by forward rotation of the sheet feeding motor 301, is capable of shifting the delivery roller 231 from the retract position to the sheet feeding position.

As described above, in the case of this Embodiment, the first lever 914 is disposed in the position to be exposed operably when the storage section 210 is pulled out from the housing 240. By this means, the user is capable of easily varying the press force of the delivery roller 231 with simple configuration.

Further, in the case of this Embodiment, provided is the second lever 924 hidden by the support plate 240, when the delivery roller 231 is positioned in the retract position. By this means, the second lever 924 is disposed in the place where the user is hard to operate, and thereby, is capable of being made the operation section for the service person.

The present invention is described above with reference to the preferred Embodiment, but it is obvious that the invention is not limited to the above-mentioned Embodiment, and is capable of being carried into practice with various changes or modifications thereof within the technical scope of the invention.

This application claims priority from Japanese Patent Application No. 2022-071725 filed on Apr. 25, 2022, and all of described contents described in the Japanese Patent Application are incorporated herein by reference.

The invention claimed is:

1. A sheet feeding apparatus for feeding sheets, comprising:

a storage chamber adapted to store sheets;

a sheet feeding unit including a delivery roller for contacting the sheets stored in the storage chamber to deliver the sheets from the storage chamber;

a support member adapted to support the storage chamber to allow the chamber to be installed and pulled out in/from an apparatus main body; and a press force switch mechanism including an operation member to switch a press force used for the delivery roller to contact the sheets, wherein the sheet feeding unit is configured to be capable of being installed and pulled out in/from the apparatus main body integrally with the storage chamber, and the press force switch mechanism is provided in the sheet feeding unit.

2. The sheet feeding apparatus according to claim 1, wherein the operation member of the press force switch mechanism is disposed in a position for allowing the operation member to be operated in a state in which the sheet feeding unit is pulled out.

3. The sheet feeding apparatus according to claim 2, wherein the operation member shifts to a first position for bringing the delivery roller into contact with the sheets by a first press force, and a second position for bringing the delivery roller into contact with the sheets by a second press force lower than the first press force.

4. The sheet feeding apparatus according to claim 1, wherein the operation member is capable of shifting to a first position for bringing the delivery roller into contact with the sheets by a first press force when weight of the sheets is a predetermined value or more, and a second position for bringing the delivery roller into contact with the sheets by a second press force lower than the first press force when weight of the sheets is smaller than the predetermined value.

5. A sheet feeding apparatus for feeding sheets, comprising:

a storage chamber adapted to store sheets;

a sheet feeding unit including a delivery roller for contacting the sheets stored in the storage chamber to deliver the sheets from the storage chamber;

a support member adapted to support the storage chamber to allow the chamber to be installed and pulled out in/from an apparatus main body;

a first press force switch mechanism including a first operation member to switch a press force used for the delivery roller to contact the sheets; and a second press force switch mechanism including a second operation member to switch a press force used for the delivery roller to contact the sheets, wherein the sheet feeding unit is configured to be capable of being installed and pulled out in/from the apparatus main body integrally with the storage chamber, and the first press force switch mechanism and the second press force switch mechanism are provided in the sheet feeding unit.

6. The sheet feeding apparatus according to claim 5, wherein the first operation member is disposed in a position to be operable in a state in which the sheet feeding unit is pulled out, and the second operation member is disposed in a position to be not operable in the state in which the sheet feeding unit is pulled out.

7. A sheet feeding apparatus for feeding sheets, comprising:

a storage chamber adapted to store sheets;

a delivery roller for contacting the sheets stored in the storage chamber to deliver the sheets from the storage chamber;

a support member adapted to support the storage chamber to allow the chamber to be installed and pulled out in/from an apparatus main body; and an operation member configured to be operated by an operator to adjust a press force of the delivery roller contacting the sheets, wherein the operation member is installed and pulled out in/from the apparatus main body integrally with the storage chamber.

8. The sheet feeding apparatus according to claim 7, wherein the operation member shifts to a first position for contacting the delivery roller with the sheets by a first press force, and a second position for contacting the delivery roller with the sheets by a second press force lower than the first press force.

9. The sheet feeding apparatus according to claim 7, wherein the operation member is capable of shifting to a first position for contacting the delivery roller with the sheets by a first press force when weight of the sheets is a predetermined value or more, and a second position for contacting the delivery roller with the sheets by a second press force lower than the first press force when weight of the sheets is smaller than the predetermined value.

10. The sheet feeding apparatus according to claim 7, wherein the operation member is disposed in a position for allowing the operation member to be operated by the operator in a state in which the delivery roller is pulled out.

* * * * *